US010543960B2

(12) United States Patent
Lane et al.

(10) Patent No.: US 10,543,960 B2
(45) Date of Patent: Jan. 28, 2020

(54) LID FOR A BEVERAGE CONTAINER

(71) Applicant: THERMOS L.L.C., Schaumburg, IL (US)

(72) Inventors: Marvin Lane, Wheeling, IL (US); Dwayne Boroski, Lake in the Hills, IL (US)

(73) Assignee: Thermos L.L.C., Schaumburg, IL (US)

( * ) Notice: Subject to any disclaimer, the term of this patent is extended or adjusted under 35 U.S.C. 154(b) by 128 days.

(21) Appl. No.: 15/824,751

(22) Filed: Nov. 28, 2017

(65) Prior Publication Data

US 2019/0161246 A1 May 30, 2019

(51) Int. Cl.

| | |
|---|---|
| ***B65D 39/08*** | (2006.01) |
| ***B65D 39/00*** | (2006.01) |
| ***B65D 43/02*** | (2006.01) |
| *B65D 51/18* | (2006.01) |

(52) U.S. Cl.

CPC ..... *B65D 39/08* (2013.01); *B65D 39/0005* (2013.01); *B65D 43/02* (2013.01); *B65D 51/18* (2013.01); *B65D 2251/0003* (2013.01); *B65D 2543/00046* (2013.01)

(58) Field of Classification Search

CPC .... B65D 41/06; B65D 41/0471; B65D 41/04; B65D 43/02; B65D 51/18; B65D 39/10; B65D 39/08; B65D 39/0005; B65D 39/16; A47G 19/2272

USPC ..... 220/715, 714, 711, 254.8, 254.1, 259.4, 220/259.3, 256.1, 298, 293, 302, 301, 220/288, 804, 801, 212.5, 212, 324, 326, 220/315; 215/284, 280, 364, 356, 355, 215/228, 330, 329, 316, 354

See application file for complete search history.

(56) References Cited

U.S. PATENT DOCUMENTS

| | | | | |
|---|---|---|---|---|
| 9,215,942 | B2 * | 12/2015 | Bodum | A47G 19/2272 |
| 2018/0008069 | A1 * | 1/2018 | Beltrami | B65D 53/02 |
| 2018/0050845 | A1 * | 2/2018 | Chin | A47J 41/0016 |
| 2018/0194524 | A1 * | 7/2018 | Chalermwinsuekun | B65D 51/18 |

* cited by examiner

*Primary Examiner* — Robert J Hicks
(74) *Attorney, Agent, or Firm* — Polsinelli PC

(57) ABSTRACT

A lid with a stopper for use with a beverage container is described. The lid includes a lid body to fit into an opening of the beverage container. The lid includes a stopper to threadably engage with the lid body. A drink opening is formed between the lid body and the stopper. The stopper rotates between open and closed positions to open and close the drink opening. The stopper includes hook members. The hook members are movable relative to the stopper. The hook members releasably hold the stopper to the lid.

20 Claims, 14 Drawing Sheets

LID FOR A BEVERAGE CONTAINER

FIELD OF INVENTION

The present invention relates to a lid with a stopper for use with a container, such as a beverage container.

BACKGROUND

Prior beverage lids of drinking containers may include a stopper that must be fully removed before drinking or pouring from the drinking container. This may be inconvenient for the user. Further, the fully removed lid may be lost.

Prior beverage lids of drinking containers may also include a stopper that is openable—but not removable. Such beverage lids may be difficult to wash, as the stopper is always engaged to the drinking container. Various surfaces of such beverage lids and their stoppers are often hidden by lid and stopper components and are difficult to access for a thorough cleaning.

Prior beverage lids of drinking containers may include a stopper that closes a single discrete opening formed in a particular location in the lid. The user may accidentally try and drink from the container at a location without the single discrete opening—and spill the beverage.

SUMMARY

Certain embodiments of a lid with a stopper for use with a beverage container are shown and described. The stopper selectively opens and closes the lid for drinking or pouring a beverage from the beverage container. The stopper screws to a closed position to close a drinking opening between the stopper and a lid body. The stopper also unscrews to open the drinking opening between the stopper and the lid body.

The stopper includes outer threads that engage with inner threads of the lid body. When the stopper is unscrewed to disengage the outer threads of the stopper from the inner threads of the lid body, the stopper remains held to the lid body via hook members. The hook members provide for removable engagement between the lid body and the stopper. The user may press the hook members inward to release the stopper from the lid body for cleaning purposes. The entire stopper may then be conveniently removed from the lid body for cleaning and later returned to the lid body for further use.

The lid body and the stopper include two holding or engaging mechanisms to hold or engage the stopper to the lid body. First, the stopper threadably engages to the lid body. Second, the hook members of the stopper hold the stopper to the lid body. The two holding or engaging mechanisms are releasable by the user in order to completely separate the stopper from the lid body.

The lid body and stopper provide for a spill and leak resistant beverage container having an approximately 360 degree drink opening that may be drunk from without having to fully remove the stopper from the lid body. The stopper generally seals the lid body to a closed position.

In order to drink through the lid body, there is no need to completely remove the lid body or the stopper to drink from the container. This helps reduce accidental loss of the lid body or stopper. This also helps to maintain a sanitary condition of the lid body—as the lid body is not removed unnecessarily exposed to dirt and other contamination. However, as described herein, the stopper may be completely removed from the lid body for cleaning. Of course, the user may also drink from the container with the stopper totally removed from the lid body.

During an opening process, the user rotates the stopper to the left relative to the lid body to open the 360 degree drink opening between the stopper and the lid body. During a closing process, the user rotates the stopper rotates to the right to close the drink opening. If the user keeps rotating the stopper in the left direction, the stopper just keeps turning indefinitely (and stays open), but there is a little resistance encountered by the user (during rotation) so that the user knows when the drink opening is open all the way. Of course, one of ordinary skill in the art will recognize that the closing and opening directions may be reversed, i.e., the lid body and the stopper may be alternatively configured to open by turning the stopper to the right and to close by turning the stopper to the left.

In one aspect, a lid for a beverage container is described. The lid includes a lid body configured to fit into an opening of a drink container. The lid includes a stopper. A drink opening is formed between the lid body and the stopper. The stopper is configured to threadably engage with the lid body. The stopper rotates between open and closed positions to open and close the drink opening. The stopper includes hook members. The hook members are movable relative to the stopper. The hook members are configured to releasably hold the stopper to the lid.

In another aspect, a lid for a beverage container is described. The lid includes a lid body having an upper rim leading to a central opening. The lid body includes sidewalls forming interior threads. The lid body includes a lower rim. The lid includes a stopper configured to close the central opening of the lid body. The stopper includes exterior threads. A drink opening is between the lid body and the stopper. The exterior threads of the stopper engage with the interior threads of the lid body. Threading and unthreading the stopper to the lid body opens and closes the drink opening between the lid body and the stopper. The stopper includes hook members. The hook members are movable relative to the stopper to releasably engage with the lower rim of the lid body. The inner threads of the lid body include gaps to provide for the passage of the hook members. The hook members are configured to move between a relaxed position and a biased position. In the biased position, the hook members may pass through the gaps. This provides for the complete separation of the stopper from the lid body. When the hook members are in the biased position, the hook members may pass through the gaps.

In another aspect, a beverage container assembly is described. The beverage container assembly includes a beverage container having walls defining an interior volume to hold a beverage. The walls include an interior surface having interior threads. The beverage container assembly includes lid body having an upper rim defining a central opening. The lid body includes sidewalls. The sidewalls including interior threads and exterior threads. The lid body includes a lower rim. Exterior threads of the lid body engage with the interior threads of the beverage container. A stopper is configured to close the central opening of the lid body. The stopper includes exterior threads. The exterior threads of the stopper engage with the interior threads of the lid body. Threading and unthreading the stopper to the lid body opens and closes a drink opening between the lid body and the stopper. The stopper includes hook members. The hook members are movable relative to the stopper to releasably engage with the lower rim of the lid body. The inner threads of the lid body include gaps to provide for the passage of the hook members.

In other aspects, biasing members of the stopper may bias or resiliently flex to engage to the lid body. The biasing members bias or flex relative to the stopper. The biasing members removably hold the stopper to the lid body. In certain aspects, the biasing members may be employed instead of the hook members.

In other aspects, frictional engaging members may extend from the stopper and frictionally engage to the lid body. The frictional engaging members flex or move relative to the stopper. The frictional engaging members removably hold the stopper to the lid body. In certain aspects, the frictional engaging members may be employed instead of the hook members.

DETAILED DESCRIPTION OF INVENTION

Figure 1:
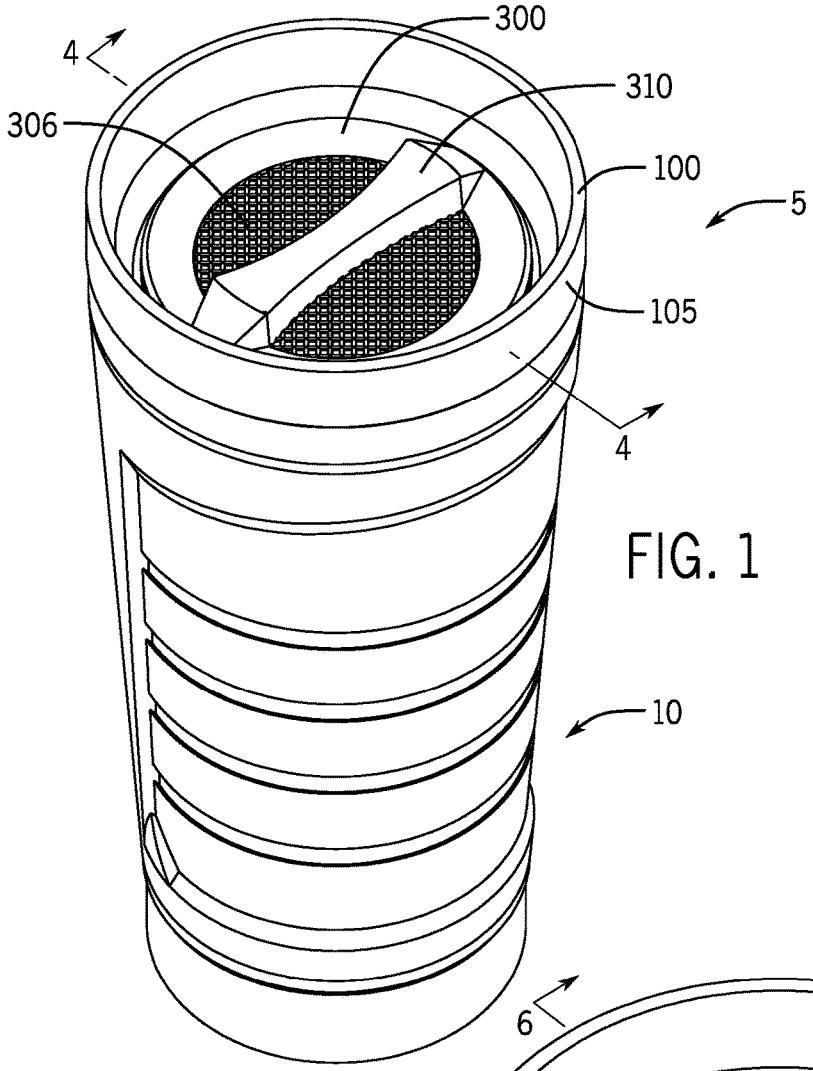
FIG. 1 is perspective view of a first embodiment of the beverage container assembly.
Figure 2:
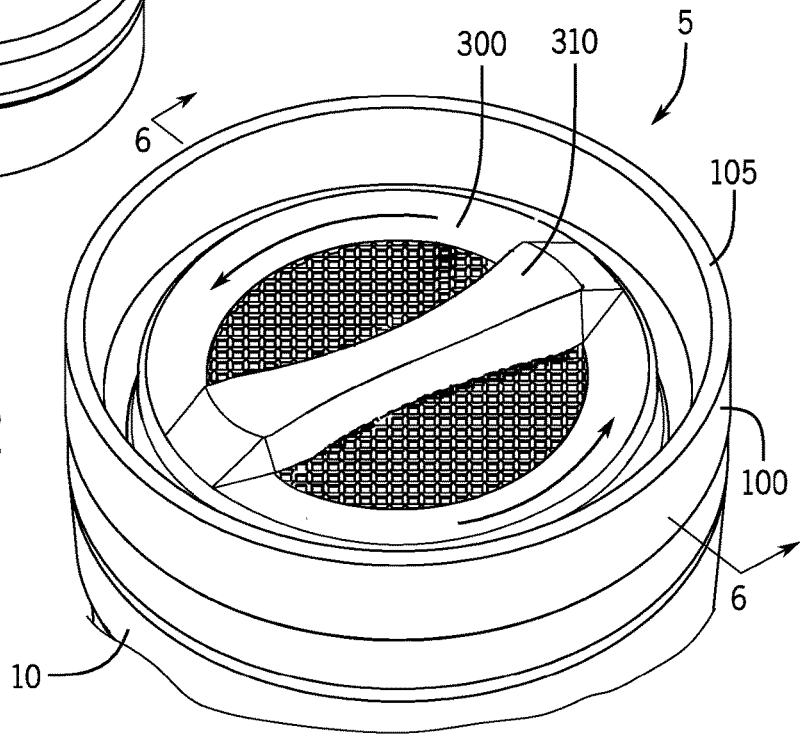
FIG. 2 is a partial upper perspective view of the first embodiment of the beverage container assembly.

For purposes of this application, any terms that describe relative position (e.g., "upper", "middle" "lower", "outer", "inner", "above", "below", "bottom", "top", etc.) refer to an embodiment of the invention as illustrated, but those terms do not limit the orientation in which the embodiments can be used.

A beverage container assembly 5 will now be described with references to FIGS. 1-10. The beverage container assembly 5 includes a beverage container 10, a lid body 100, and a stopper 300. The beverage container includes walls 11 defining an interior volume to hold a beverage. The stopper 300 threadably engages into a central opening 110 of the lid body 100. The stopper 300 controls a flow of a drinking fluid through a drink opening 200 between the lid body 100 and the stopper 300. A combination of the lid body 100 and the stopper 300 are inserted into an upper opening 20 of the beverage container 10 to provide a selective closure to the beverage container 10.

Figure 3:
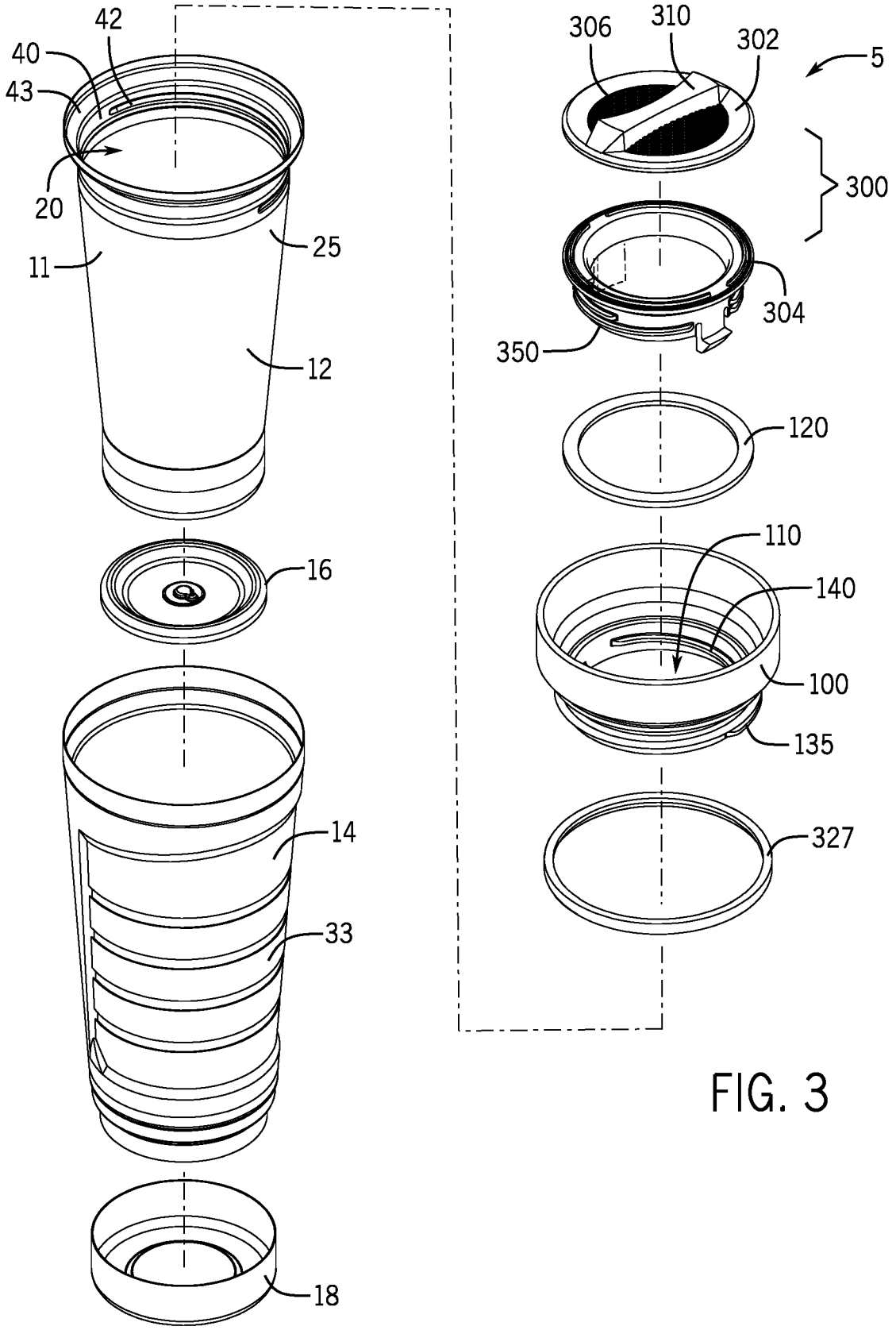
FIG. 3 is an exploded view of the first embodiment of the beverage container assembly.
Figure 4:
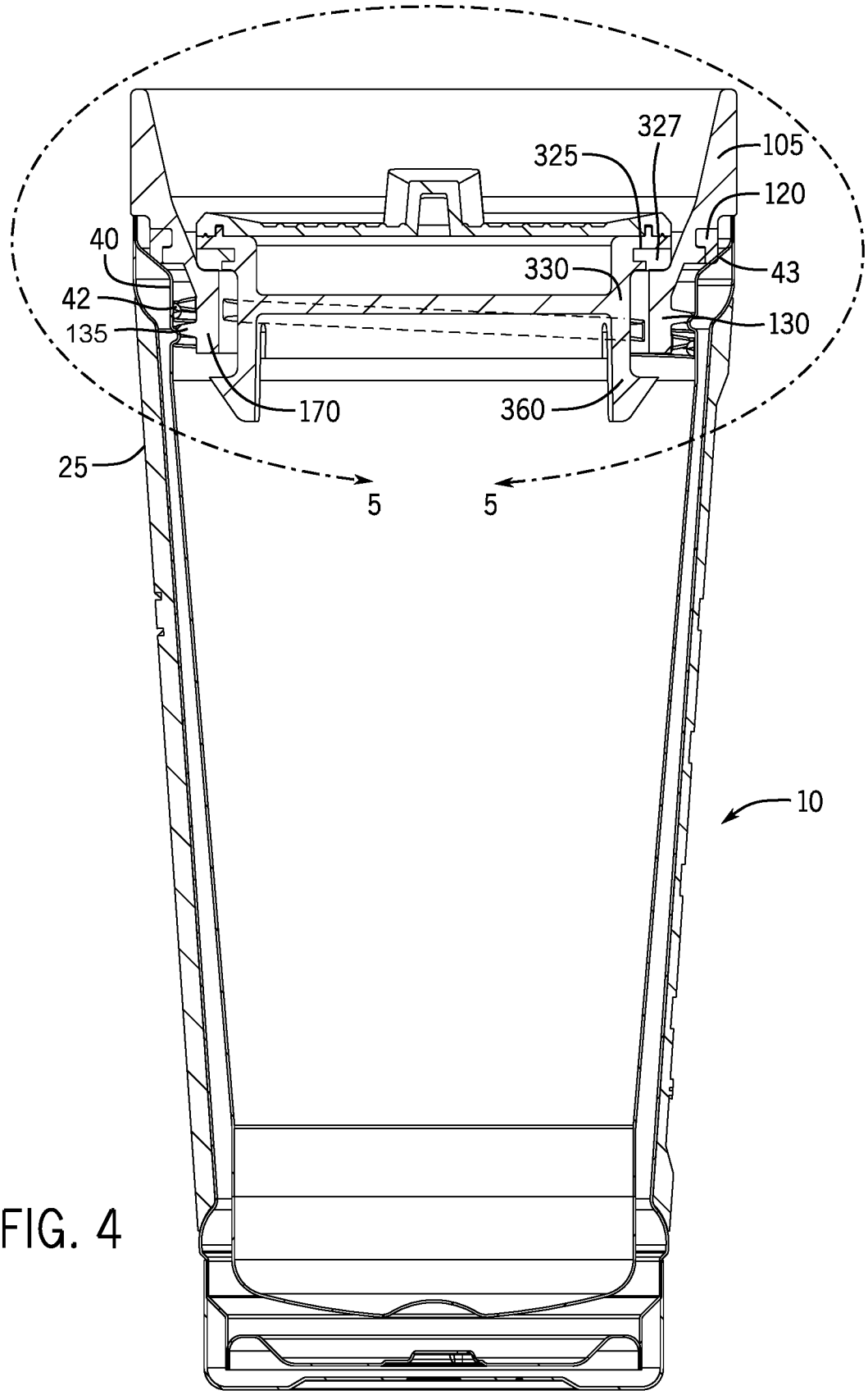
FIG. 4 is a sectional view of the first embodiment of the beverage container assembly.

The beverage container 10 is shown in detail in FIG. 3. In this aspect, a four-piece insulated beverage container 10 is illustrated, however, other types of beverage containers may be used with the lid body 100 and the stopper 300 described herein. With reference to FIG. 3, the beverage container 10 includes an inner shell 12 and an outer shell 14. The beverage container 10 further includes an inner bottom 16 and an outer bottom 18. The inner shell 12, the outer 14, the inner bottom 16, and the outer bottom 18 are welded or otherwise joined to form a thermally insulated space in the beverage container 10 to maintain a temperature of the beverage. The outer shell 14 is illustrated with a gripping member 33. However, the outer shell 14 may include any of a variety of surface features—including a smooth or plain finish as well as any other gripping members or surfaces.

The walls 11 of an upper portion 25 of the beverage container 10 include an inner surface 40 having interior threads 42. The interior threads 42 of the beverage container 10 receive exterior threads 135 of the lid body 100 to engage the lid body 100 to the beverage container 10. The lid body 100 is inserted into the upper opening 20 of the beverage container 10. The exterior threads 135 of the lid body 100 threadably engage with the interior threads 42 of the beverage container 10 to screw the lid body 100 into and/over the upper opening 20 of the beverage container 10. As the lid body 100 is screwed to the upper opening 20, a gasket 120 of the lid body 100 is urged against an interior flange surface 43 of the beverage container 10. The engagement of the gasket 120 to the interior flange surface 43 generally seals the engagement between the lid body 100 and the beverage container 10.

The lid body 100 will now be described with reference to FIGS. 8 and 9. The lid body 100 includes an upper rim 105 around the central opening 110. The upper rim 105 comes in contact with a mouth of a user when the user wishes to drink from the beverage container assembly 5. The upper rim 105 leads to or defines the central opening 110 that is generally open to receive the stopper 300. The gasket 120 extends around an outer diameter of the lid body 100. The gasket 120 is positioned below the upper rim 105 in a gasket groove 123 of the lid body 100. The lid body 100 further includes a sidewall 130 forming a lower diameter of the lid body 100. The sidewall 130 includes the exterior threads 135 that threadably engage with the interior threads 42 of the beverage container 10.

Figure 8:
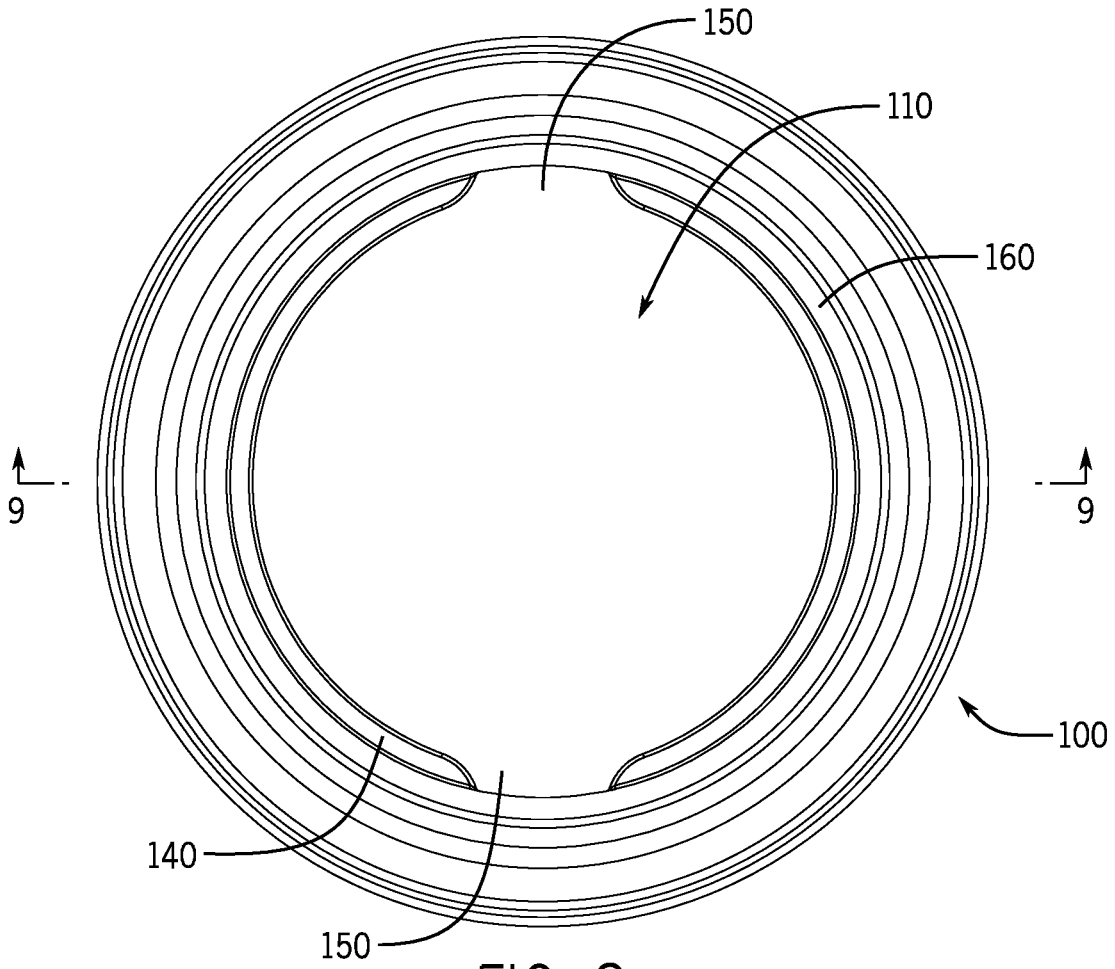
FIG. 8 is a top down view of the first embodiment of the lid body.
Figure 9:
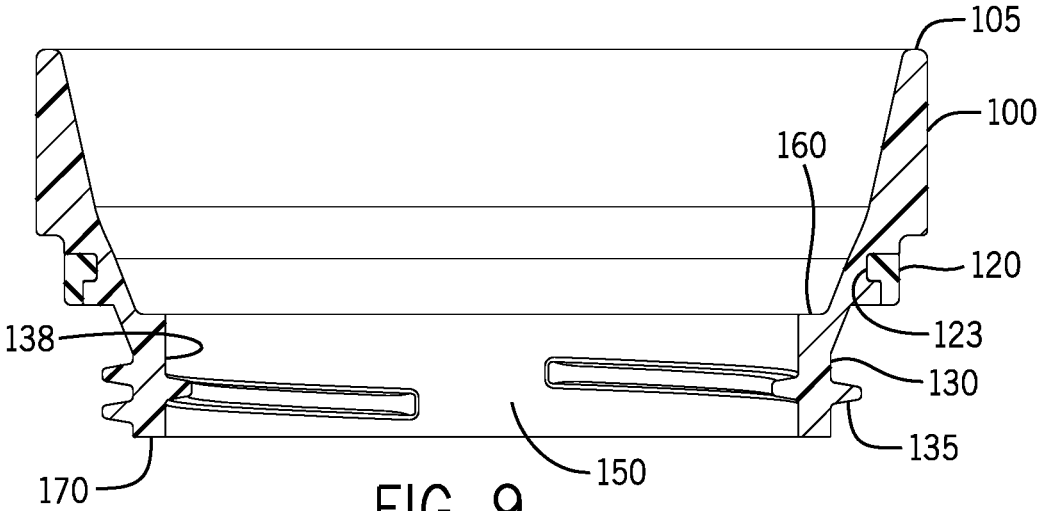
FIG. 9 is a sectional view of the first embodiment of the lid body.
Figure 11:
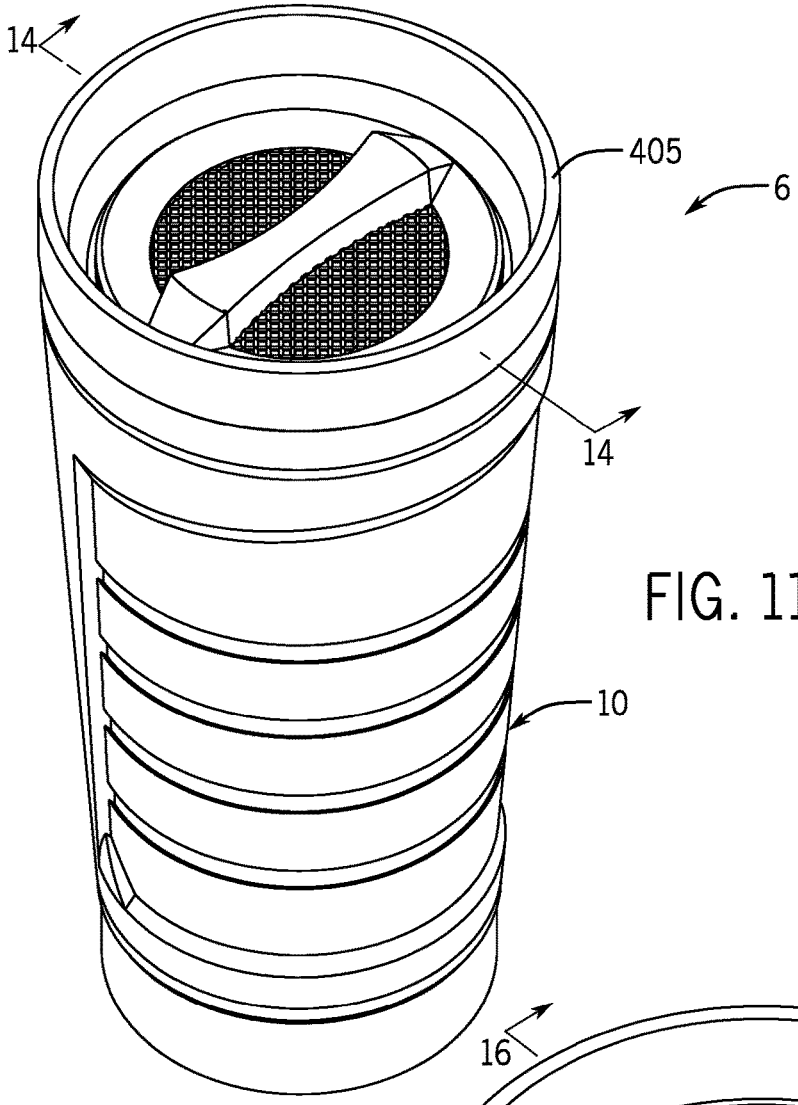
FIG. 11 is perspective view of a second embodiment of the beverage container assembly.
Figure 12:
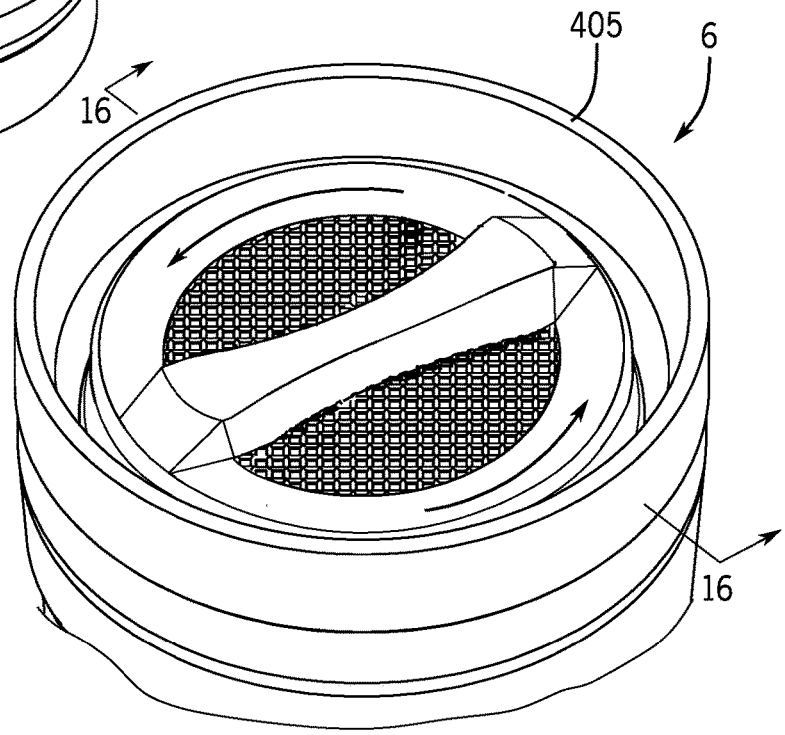
FIG. 12 is a partial upper perspective view of the second embodiment of the beverage container assembly.
Figure 13:
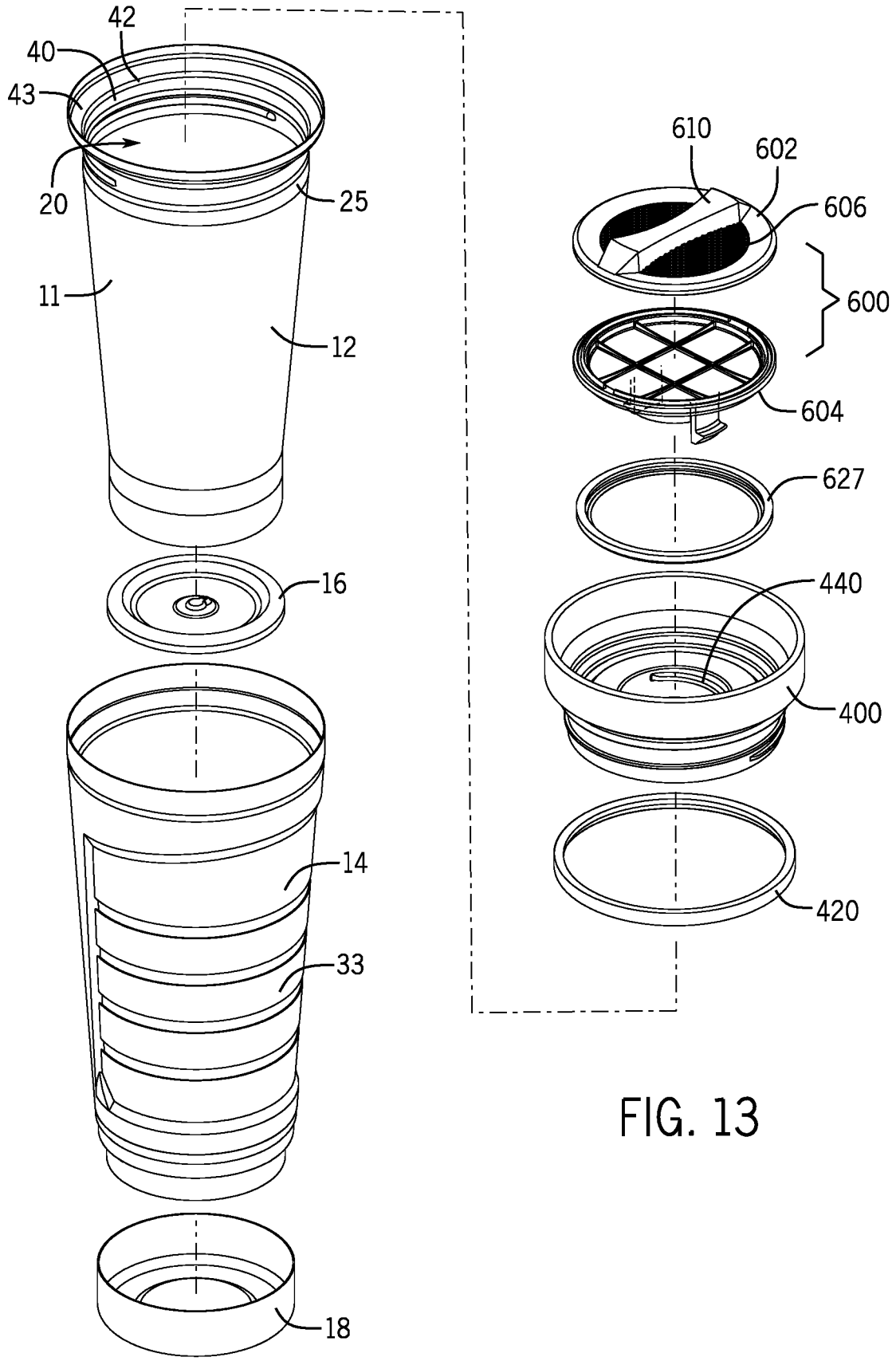
FIG. 13 is an exploded view of the second embodiment of the beverage container assembly.
Figure 14:
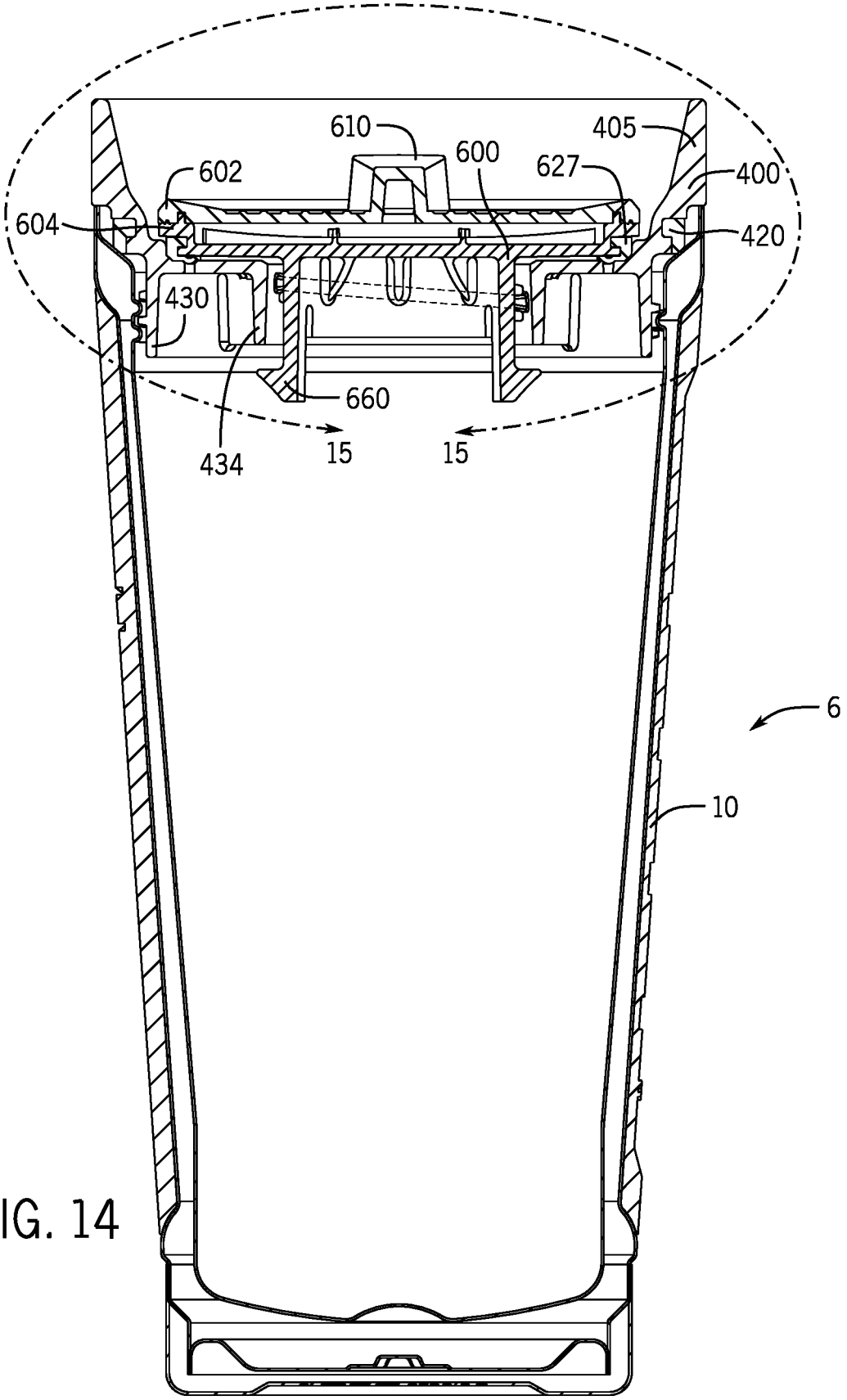
FIG. 14 is a sectional view of the second embodiment of the beverage container assembly.

With reference to FIGS. 8 and 9, the exterior threads 135 of the lid body 100 further include gaps 150 in the interior threads 140. The gaps 150 are breaks, openings, voids, etc. in the interior threads 140 of the lid body 100. The gaps 150 provide a region or space on the interior of the lid body 100 having a greater internal diameter than an internal diameter of interior threads 140. The gaps 150 provide a slightly larger diameter than a diameter provided by the interior threads 140. The gaps 150 are oppositely disposed on the interior surface 138 of the lid body 100. The gaps 150 are approximately 180 degrees from each other in the interior threads 140. As described below in greater detail, the gaps 150 provide for a hook member 360 of the stopper 300 to releasably engage from the lid body 100. Although the lid body 100 is illustrated with two gaps 150, in other aspects, the lid body 100 may include one gap 150 or three or more gaps 150. However, the use of two gaps 150 allows for the user to squeeze two hook members 360 at the same time to conveniently disengage the hook members 360 from the lid body 100.

With reference to FIG. 9, the sidewall 130 includes a lower rim 170 at its bottom-most surface. The inner surface 138 of the sidewall 130 further includes an interior flange surface 160. The interior flange surface 160 is generally perpendicular to the inner surface 138. The interior flange surface 160 receives a gasket 327 of the stopper 300.

Figure 6:
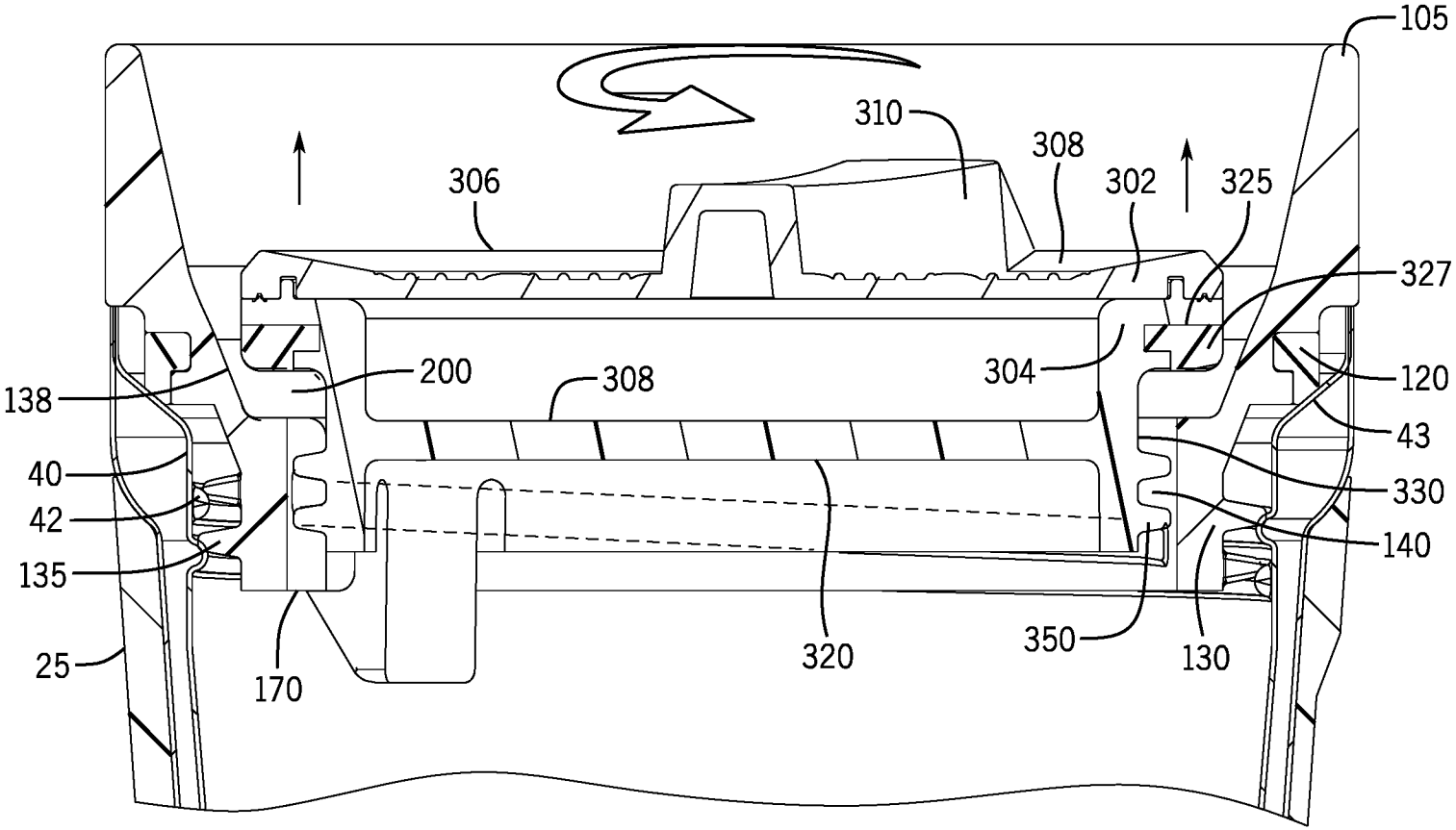
FIG. 6 is an upper perspective view of the first embodiment of the beverage container assembly with the drink opening in an open position.
Figure 7:
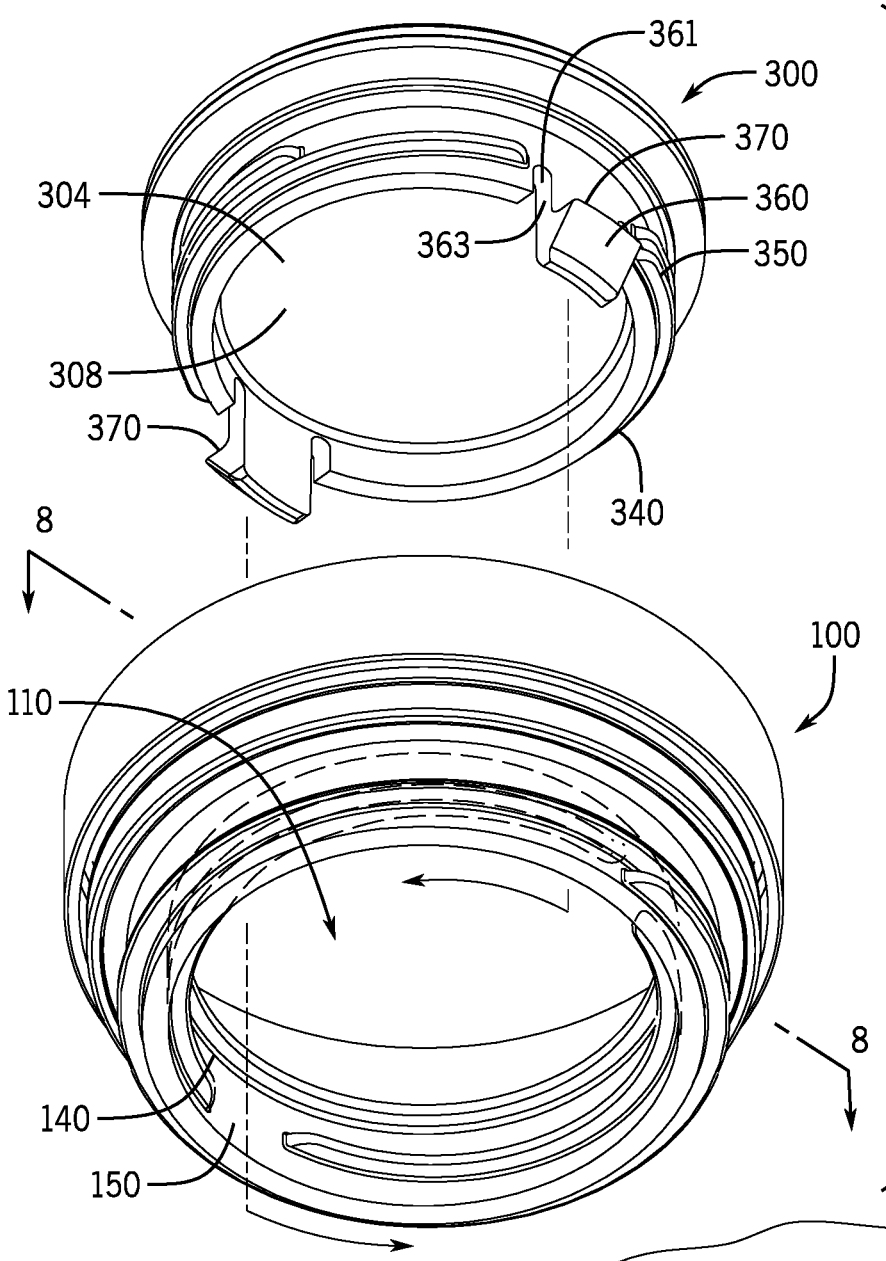
FIG. 7 is a view of the stopper of the first embodiment inserted into the lid body.
Figure 10:
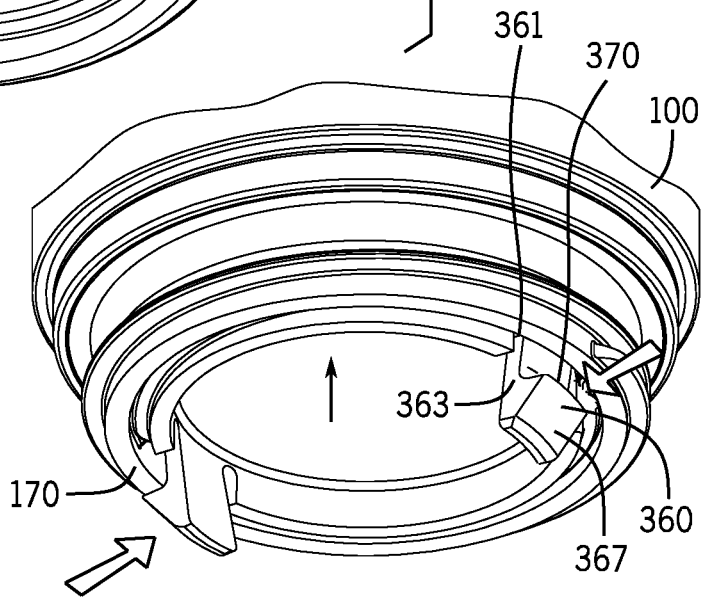
FIG. 10 is a bottom perspective view of the stopper of the first embodiment inserted into the lid body.

The stopper 300 will now be described with reference to FIGS. 6 and 7. In the aspect illustrated, the stopper 300 includes an upper portion 302 and a lower portion 304 that are affixed together. In other aspects, the stopper 300 may only include one portion i.e., the stopper 300 has a unitary body. The stopper 300 includes an upper surface 306 that includes or forms a handle 310, which provides a convenient gripping surface for the user to grip while turning the stopper 300. The stopper 300 includes a lower surface 320 opposite of the upper surface 306. The stopper 300 includes a central portion 308 that is generally solid without any openings or passages for fluid flow. The size and shape of the stopper 300 is configured to close the central opening 110 of the lid body 100.

The stopper 300 includes an exterior flange surface 325 that seals down upon the gasket 327 and against the interior flange surface 160 of the lid body 100. A lower portion of the stopper 300 includes a sidewall 330. The sidewall 330 includes the exterior threads 350 that threadably engage with the interior threads 140 of the lid body 100. The sidewall 330 terminates in a lower edge 340.

The stopper 300 includes the hook members 360 or other frictional or biasing engaging members that releasably engage with the lid body 100. The hook members 360 include a vertical portion 363 that descends below the lower edge 340 of the sidewall 330 of the stopper 300. The vertical portion 363 includes a catch 367, which for example, in this aspect, includes a horizontal or other structure generally perpendicular to the vertical portion 363. The catch 367 holds against the lower rim 170 of the lid body 100. The sidewalls 330 include relief cuts 361 adjacent to the vertical portion 363. The relief cuts 361 are generally parallel to the vertical portions 363. The combination of the relief cuts 361 and the vertical portion 363 provide the hook members 360 with resiliency to bias the catch 367. The catch 367 further includes an upper surface 370 that physically contacts the lower rim 170.

The function and operation of the beverage container assembly 5 will now be described.

As described above, the lid body 100 threadably engages or screws to the beverage container 10. The stopper 300 also threadably engages or screws to the lid body 100. When the stopper 300 is unscrewed or disengaged from the lid body 100, such as shown in FIG. 6, the drink opening 200 is formed around the exterior of the sidewall 330 and the inner surface 138 of the lid body 100. The drink opening 200 may extend approximately 360 degrees around the sidewall 330 of the stopper 300. This allows a user to drink from the beverage container assembly 5 at any orientation, i.e., the user does not need to place a specific portion of the upper rim 105 to their mouth in order to drink. This provides the user with flexibility to drink from anywhere on the lid body 100. This may reduce the likelihood of spills and provides the user with added convenience.

Figure 5:
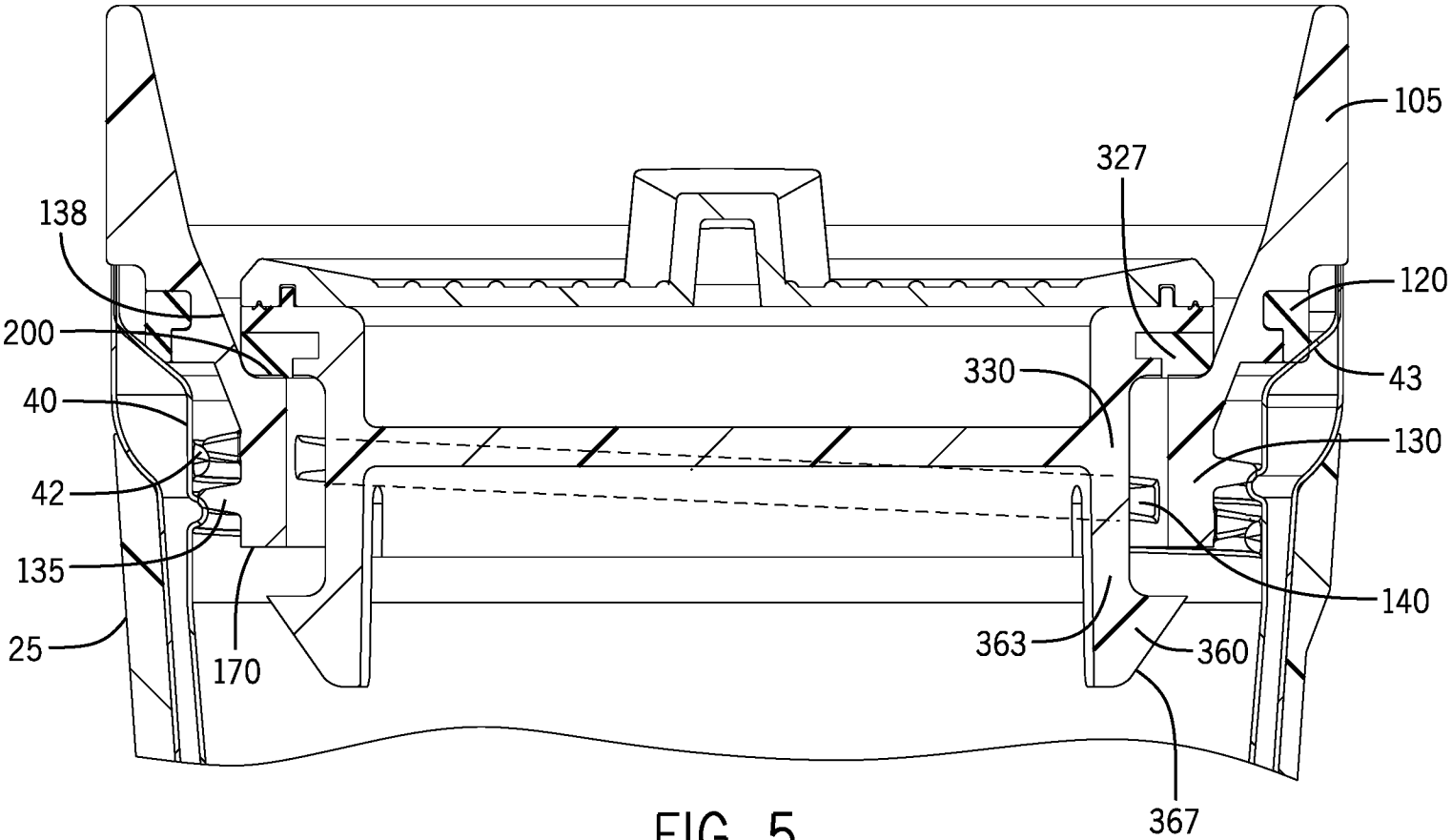
FIG. 5 is a sectional view of the first embodiment of the upper portion of the beverage container assembly with the drink opening in a closed position.

The stopper 300 may be fully screwed or fully threaded to the lid body 100, such as shown in FIG. 5, to provide nearly complete closure of the beverage container assembly 5 to provide a generally leak-resistant or spill-resistant beverage container assembly 5. In order to open the beverage container 5 for drinking or pouring, the stopper 300 is unscrewed or unthreaded from the lid body 100 until the drink opening 200 is formed. The stopper 300 may be fully or partially unscrewed or unthreaded from the lid body 100 in order to drink from or pour from the container assembly 5.

When the exterior threads 350 of the stopper 300 are fully disengaged from the interior threads 140 of the lid body 100, the stopper 300 is still held to the lid body 100 by the hook members 360. As such, the beverage container assembly 5 includes both the threaded engagement between the interior threads 140 and the exterior threads 350, as well as the engagement between the hook members 360 and the lower rim 170 of the lid body 100 to hold the stopper 300 to the lid body 100. This allows the user to fully open the stopper 300 from the lid body 100 to fully open the drink opening 200, while the stopper 300 is not fully removed from the lid body 100. This provides convenience in that the stopper 300 need not be removed. This may reduce accidental loss of the stopper 300. This further promotes cleanliness as the liquid contacting portions of the stopper 300 are not unnecessarily subject to physical contact with contamination and/or debris.

As described below, the stopper 300 includes the hook members 360 that allow the stopper 300 to be removably disengaged from the lid body 100. The hook members 360 are configured to move between a relaxed position and a biased position. The biased position provides for the hook members 360 to pass through the two gaps 150. In the relaxed position, the hook members 360 hold against the lower rim 170. For example, the user may squeeze on both of the hook members 360 causing the hook members 360 to flex inward toward a central axis of the lid body 100. This reduces a distance between the hook members 360. The gaps 150 provide a region or space in an interior of the lid body 100 having a greater internal diameter than an internal diameter of interior threads 140. This allows the catches hook members 360 to be removed via the gaps 150 in the interior threads 140 of the lid body 100. In order to remove the stopper 300, the stopper 300 is rotated to the left in order to fully disengage the exterior threads 350 of the stopper 300 from the interior threads 140 of the lid body 100. After the threads 140 and 350 are fully disengaged, the user lines up the hook members 360 with the gaps 150. The user then squeezes on the hook members 360 to flex the hook members 360 inward in order to withdraw the hook members 360 from holding against the lower rim 170. The hook members 360, when flexed inward sufficiently, may pass through the gaps 150 in the interior threads 140. At this point, the stopper 300 may be fully removed from the lid body 100 for cleaning.

The stopper 300 may be turned indefinitely to the opening direction, which in this aspect, is in the left direction. No matter how much the stopper 300 is turned to the left, the stopper 300 still remains engaged to the lid body 100 via the hook members 360. This provides the user with assurance that the beverage container assembly 500 is in a completely open position. However, the stopper 300 will only turn a finite amount of rotation in the closing or right direction, as the exterior threads 350 of the stopper 300 will fully engage to the interior threads 140 of the lid body 100. Eventually, after sufficient turning in the closing or right direction, the stopper 300 will be fully seated against the lid body 100.

When the stopper 300 is turned in the open direction and the exterior threads 350 are disengaged from the interior threads 140, the stopper 300 will continue to rotate with an amount of frictional force that the user may feel when turning the stopper 300. This indicates to the user that the stopper 300 is in fully open position. When the stopper 300 is rotated in its disengaged position, the upper surface 370 of the catch 367 may rub against the lower rim 170. In contrast, when the stopper 300 is fully engaged to lid body 100 and the beverage container assembly 5 is closed, the upper surface 370 has dropped below the lower rim 170.

The lid 100 is configured to removably connect to the container 10. In other aspects, the lid 100 and container 10 may include other removable connection components or configurations, such as different complementary threads, snap engagement, press-fit engagement, bayonet engagement, a frictional configuration, etc.

The beverage container 10 may be made from any suitable material, including a generally rigid material, a generally flexible material, a generally insulated material, or a generally non-insulated material. Examples of beverage container 10 materials include metal (e.g., stainless steel), glass, rubber, silicone, plastic (e.g., food grade plastic), etc. or any combination thereof. An insulated material may include a double-wall vacuum insulated construction or foam insulation. In FIGS. 1-20, the beverage container 10 is made from stainless steel.

The lid body 100 and stopper 300 will generally be made from any suitable material, including a generally rigid material, a generally flexible material, a generally insulated material, or a generally non-insulated material. Example of materials for the lid body 100 and stopper 300 include moldable food-grade plastics, thermoplastics, etc. or any combination thereof. The stopper 300 and/or lid body 100 may include an insulated construction.

A beverage container assembly 6 will now be described with references to FIGS. 11-20. The beverage container assembly 6 includes the beverage container 10 described above with a lid body 400 and a stopper 600. The lid body 400 and the stopper 600 function similar to the lid body 100 and the stopper 300. The lid body 400 includes a central opening 410 with a smaller diameter than the central opening 110 of the lid body 100.

The stopper 600 threadably engages into the central opening 410 of the lid body 400. The stopper 600 controls a flow of a drinking fluid through a drink opening 500 between the lid body 400 and the stopper 600. A combination of the lid body 400 and the stopper 600 are inserted into an upper opening 20 of the beverage container 10 to provide a selective closure to the beverage container 10.

The interior threads 42 of the beverage container 10 receive exterior threads 435 of the lid body 400 to engage the lid body 400 to the beverage container 10. The lid body 400 is inserted into the upper opening 20 of the beverage container 10. The exterior threads 435 of the lid body 400 threadably engage with the interior threads 42 of the beverage container to screw the lid body 400 into and/over the upper opening 20 of the beverage container 10. As the lid body 400 is screwed to the upper opening 20, a gasket 420 of the lid body 400 is urged against an interior flange surface 43 of the beverage container 10. The engagement of the gasket 420 to the interior flange surface 43 generally seals the engagement between the lid body 400 and the beverage container 10.

The lid body 400 will now be described with reference to FIGS. 18 and 19. The lid body 400 includes an upper rim 405, which transitions to a central flange 408, which is around the central opening 410. A bottom surface 412 of the central flange 408 includes a plurality of supports 414. The upper rim 405 comes in contact with a mouth of a user when the user wishes to drink from the beverage container assembly 6. The upper rim 405 defines the central opening 410 that is generally open to receive the stopper 600. The gasket 420 extends around an outer diameter of the lid body 400. The gasket 420 is positioned below the upper rim 405 in a gasket groove 423 of the lid body 400. The lid body 400 further includes an outer sidewall 430 forming a lower diameter of the lid body 400. The outer sidewall 430 includes the exterior threads 435 that threadably engage with the interior threads 42 of the beverage container 10. The lid body 400 further includes an inner sidewall 434. The inner sidewall 434 includes interior threads 440 that engage with exterior threads 650 of the stopper 600. The plurality of supports 414 may connect or join the outer sidewall 430 and the inner sidewall 434.

Figure 17:
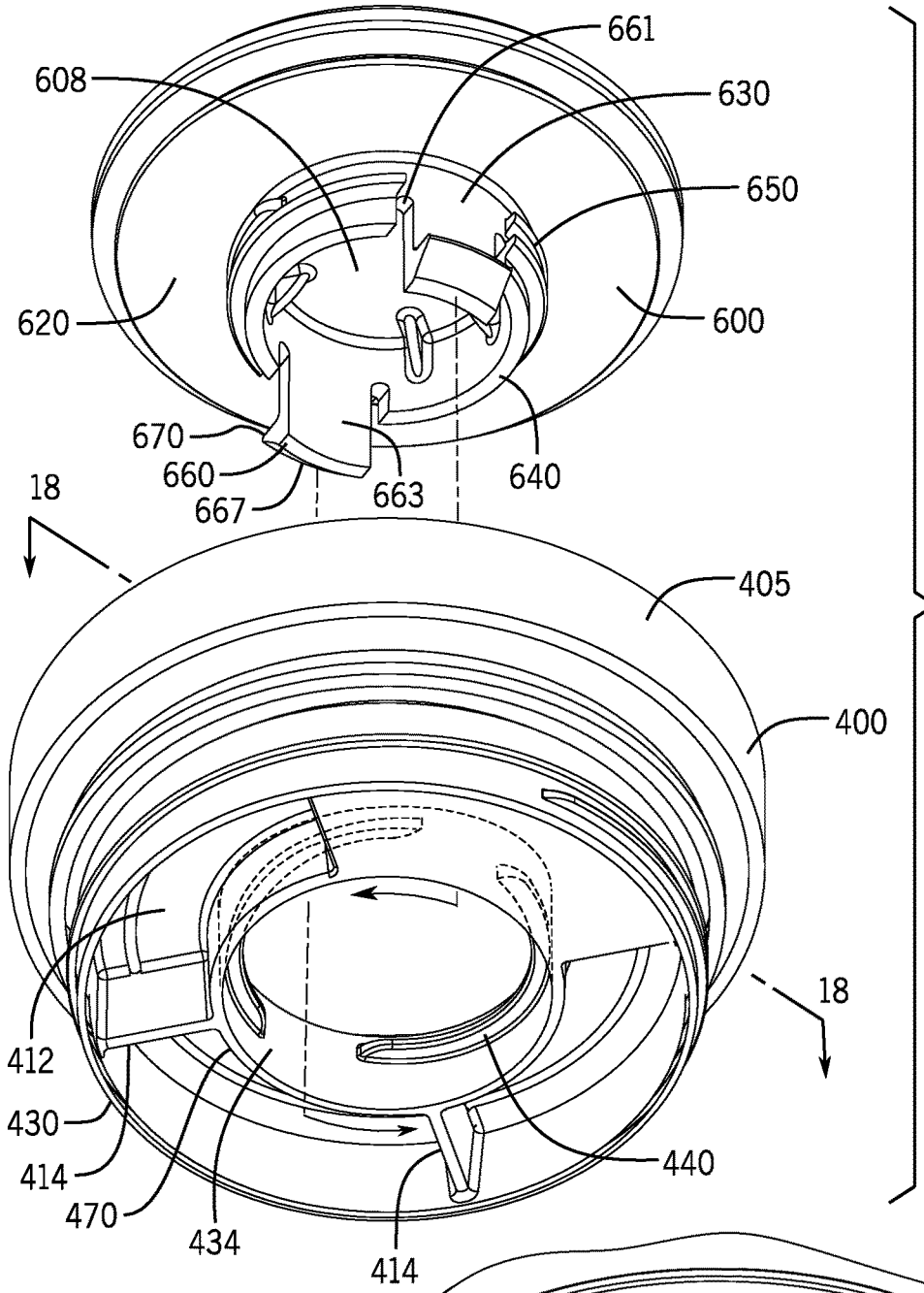
FIG. 17 is a view of the stopper of the second embodiment inserted into the lid body.
Figure 20:
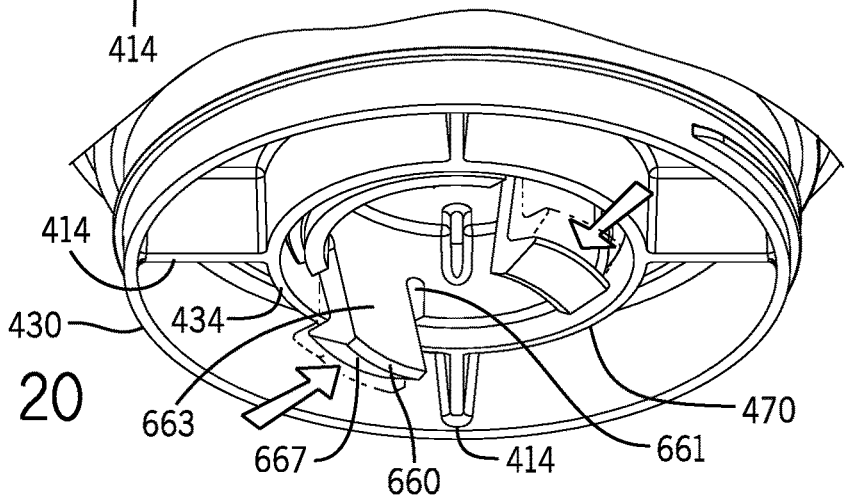
FIG. 20 is a bottom view of the stopper of the first embodiment inserted into the lid body.

The stopper 600 will now be described with reference to FIGS. 17 and 20. In the aspect illustrated, the stopper 600 includes an upper portion 602 and a lower portion 604 that are affixed together. In other aspects, the stopper 600 may only include one portion i.e., the stopper 600 has a unitary body. The stopper 600 includes an upper surface 606 that includes or forms a handle 610, which provides a convenient gripping surface for the user to grip while turning the stopper 600. The stopper 600 includes a lower surface 620 opposite of the upper surface 606. The stopper 600 includes a central portion 608 that is generally solid without any openings or passages or fluid flow. The size and shape of the stopper 600 are configured to close the central opening 410 of the lid body 400.

The stopper 600 includes an exterior flange surface 625 that seals down upon the gasket 627 and against an interior flange surface 460 of the lid body 400. A lower portion of the stopper 600 includes a sidewall 630. The sidewall 630 includes the exterior threads 650 that threadably engage with the interior threads 440 of the inner sidewall 434 of the lid body 400. The sidewall 630 terminates in a lower edge 640.

The stopper 600 includes hook members 660 that releasably engage with the lid body 400. The hook members 660 include a vertical portion 663 that descends below the lower edge 640 of the sidewall 630 of the stopper 600. The vertical portion 663 includes a catch 667, which for example, in this aspect, includes a horizontal or other structure generally perpendicular to the vertical portion 663. The catch 667 holds against the lower rim 470 of the lid body 400. The sidewalls 630 include relief cuts 661 adjacent to the vertical portion 663. The relief cuts 661 are generally parallel to the vertical portions 663. The combination of the relief cuts 661 and the vertical portion 663 provide the hook members 660 with resiliency to bias the catch 667. The catch 667 further includes an upper surface 670 that physically contacts the lower rim 470.

Figure 15:
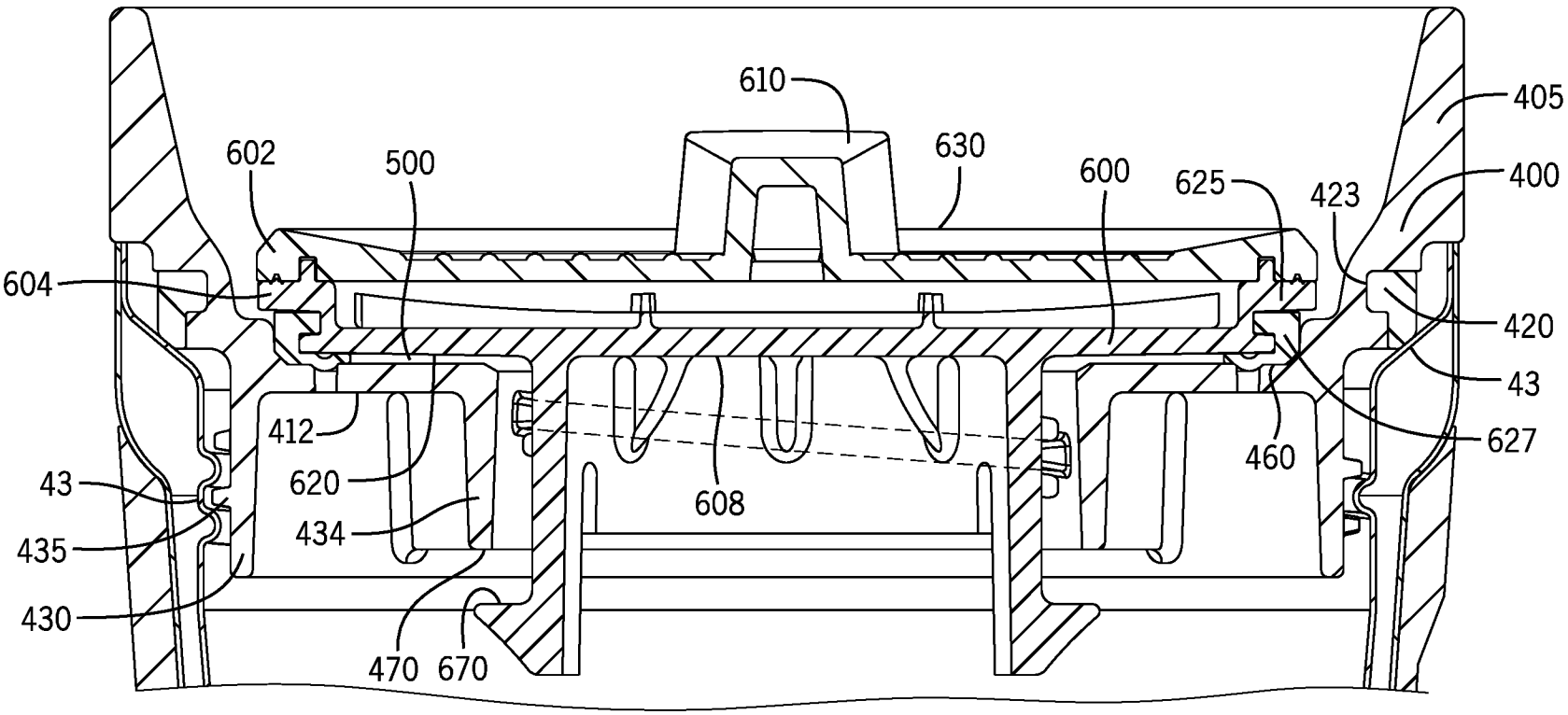
FIG. 15 is a sectional view of the second embodiment of the upper portion of the beverage container assembly.
Figure 16:
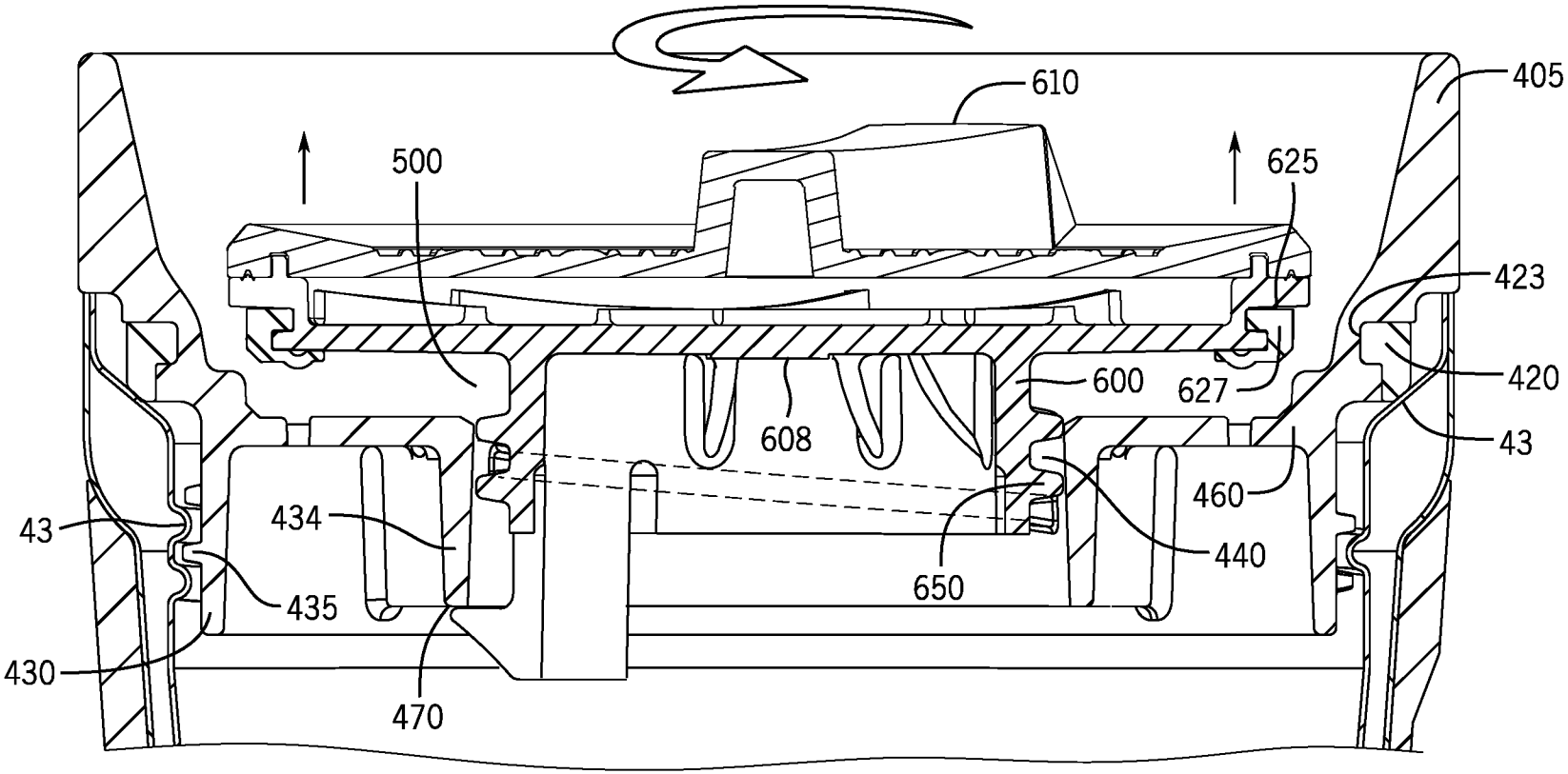
FIG. 16 is an upper perspective view of the second embodiment of the beverage container assembly.
Figure 18:
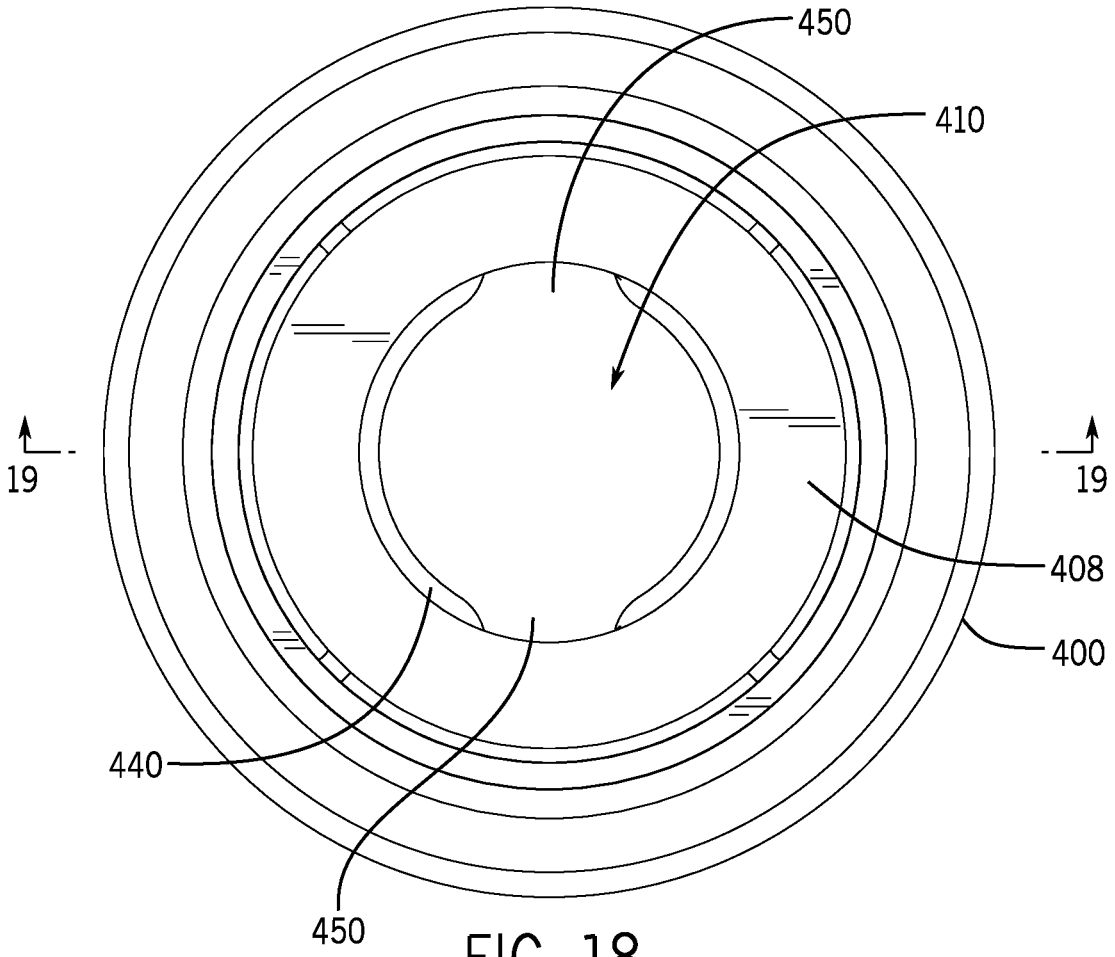
FIG. 18 is a top down view of the second embodiment of the lid body.
Figure 19:
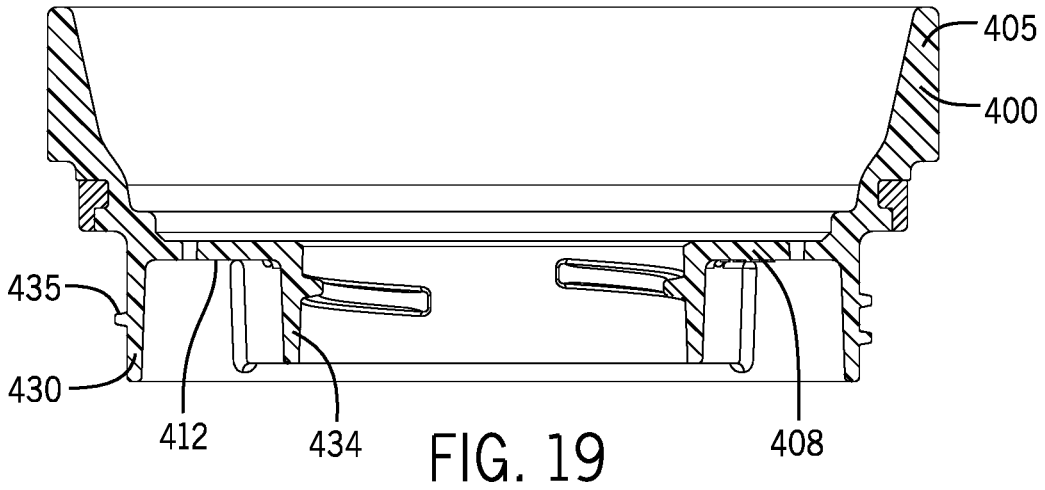
FIG. 19 is a sectional view of the second embodiment of the lid body.

With reference to FIG. 18, the interior threads 440 of the lid body 400 further include gaps 450 in the interior threads 440. The gaps 450 provide for a hook member 660 of the stopper 600 to releasably engage from the lid body 400. With reference to FIGS. 15 and 16, the sidewall 430 includes the lower rim 470 at its bottom-most surface. The lid body 400 further includes the interior flange surface 460 that receives the gasket 627 of the stopper 600.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid for a beverage container, comprising:

a lid body configured to fit into an opening of a drink container;

a stopper;

a drink opening between the lid body and the stopper;

the stopper configured to threadably engage with the lid body, wherein the stopper rotates between open and closed positions to open and close the drink opening;

wherein the stopper includes hook members, the hook members movable relative to the stopper, the hook members configured to releasably hold the stopper to the lid body; and, wherein the lid body has a sidewall, the sidewall forming interior threads, the interior threads have two gaps for passage of the hook members.

2. The lid for a beverage container according to claim 1, wherein the two gaps have a greater diameter than a diameter of the interior threads of the lid body.

3. The lid for a beverage container according to claim 1, wherein the hook members are configured to move between a relaxed position and a biased position, wherein the biased position provides for the hook members to pass through the two gaps.

4. The lid for a beverage container according to claim 1, wherein the stopper includes a sidewall, and the hook members extend from a lower edge of the sidewall of the stopper.

5. The lid for a beverage container according to claim 1, wherein the hook members include a vertical portion and a catch member.

6. The lid for a beverage container according to claim 1, wherein the stopper includes a sidewall, and the hook members extend from a lower edge of the sidewall of the stopper, the hook members include a vertical portion and a catch member, and the sidewalls include relief cuts parallel to the vertical portion.

7. The lid for a beverage container according to claim 1, wherein an upper surface of the stopper forms a handle.

8. The lid for a beverage container according to claim 1, wherein the stopper has exterior threads; and the exterior threads of the stopper engage with the interior threads of the lid body.

9. The lid for a beverage container according to claim 8, wherein threading and unthreading the exterior threads of the stopper to the interior threads of the lid body opens and closes the drink opening between the lid body and the stopper.

10. The lid for a beverage container according to claim 9, wherein the stopper is held to the lid body by the hook members after the exterior threads of the stopper are completely unthreaded from the interior threads of the lid body.

11. The lid for a beverage container according to claim 1, wherein the stopper is configured to rotate indefinitely in an open direction.

12. The lid for a beverage container according to claim 1, wherein the drink opening is approximately 360 degrees between the stopper and the lid body.

13. The lid for a beverage container according to claim 1, wherein the hook members are movable relative to the stopper to releasably engage with a lower rim of the lid body.

14. The lid for a beverage container according to claim 1, wherein the hook members include a vertical portion and a catch portion, the catch portion positioned generally perpendicular to the vertical portion, and the catch portion configured to contact a lower rim of the lid body.

15. The lid for a beverage container according to claim 14, wherein the hook members are configured to move between a relaxed position and a biased position, wherein in the relaxed position, the catch portion is configured to contact the lower rim of the lid body, and wherein in the biased position, the catch portion is configured to move toward a central axis of the stopper and not contact the lower rim of the lid body.

16. The lid for a beverage container according to claim 1, wherein the drink opening is opened without complete removal of the stopper from the lid body.

17. A beverage container comprising the lid according to claim 1.

18. A lid for a beverage container, comprising:

a lid body having an upper rim leading to a central opening, the lid body having sidewalls forming interior threads, the lid body having a lower rim;

a stopper configured to close the central opening of the lid body, the stopper having exterior threads;

a drink opening between the lid body and the stopper;

the exterior threads of the stopper engage with the interior threads of the lid body, wherein threading and unthreading the stopper to the lid body opens and closes the drink opening between the lid body and the stopper;

the stopper having hook members, the hook members movable relative to the stopper to releasably engage with the lower rim of the lid body;

the inner threads of the lid body include gaps to provide for the passage of the hook members; and, wherein the hook members configured to move between a relaxed position and a biased position, wherein the biased position provides for the hook members to pass through the gaps.

19. A beverage container assembly, comprising:

a beverage container having walls defining an interior volume to hold a beverage, the walls having an interior surface having interior threads;

a lid body having an upper rim defining a central opening, the lid body having sidewalls, the sidewalls forming interior threads and exterior threads, the lid body having a lower rim;

the exterior threads of the lid body engage with the interior threads of the beverage container;

a stopper configured to close the central opening of the lid body, the stopper having exterior threads;

the exterior threads of the stopper engage with the interior threads of the lid body, wherein threading and unthreading the stopper to the lid body opens and closes a drink opening between the lid body and the stopper;

the stopper having hook members, the hook members movable relative to the stopper to releasably engage with the lower rim of the lid body; and, the inner threads of the lid body include gaps to provide for the passage of the hook members.

20. A lid for a beverage container, comprising:

a lid body configured to fit into an opening of a drink container;

a stopper;

a drink opening between the lid body and the stopper;

the stopper configured to threadably engage with the lid body, wherein the stopper rotates between open and closed positions to open and close the drink opening;

wherein the stopper includes a hook member, the hook member movable relative to the stopper, the hook member configured to releasably hold the stopper to the lid; and, wherein the lid body has a sidewall, the sidewall forming interior threads, the interior threads having a gap for passage of the hook member.

* * * * *